United States Patent [19]

Prokhorov et al.

[11] Patent Number: 5,050,687

[45] Date of Patent: Sep. 24, 1991

[54] COMPRESSION-VACUUM ACTION PERCUSSIVE MACHINE

[76] Inventors: Ivan A. Prokhorov, ulitsa Smuryakova, 9, kv. 48, Moskovskaya oblast, Ivanteevka; Vitold A. Kezik, ulitsa Stradnieku, 99, kv. 54; Igor S. Agafonov, ulitsa Karla Marxa, 25, kv. 5, both of Daugavpils; Jury N. Kolgan, ulitsa Planernaya, 14, korpus 2, kv. 13, Moscow; Boris G. Goldshtein, ulitsa Molodogvardeiskaya, 24, korpus 1, kv. 26, Moscow; Igor V. Nikolaev, ulitsa Musy Dzhalilya, 29, korpus 1, kv. 152, Moscow, all of U.S.S.R.

[21] Appl. No.: 460,345

[22] PCT Filed: Aug. 9, 1989

[86] PCT No.: PCT/SU89/00206

§ 371 Date: May 14, 1990

§ 102(e) Date: May 14, 1990

[87] PCT Pub. No.: WO90/03252

PCT Pub. Date: Apr. 5, 1990

[30] Foreign Application Priority Data

Sep. 23, 1988 [SU] U.S.S.R. ..... 4485925

[51] Int. Cl.[5] ..... B25D 9/04; B25D 17/24

[52] U.S. Cl. ..... 173/133; 173/104; 173/135; 173/139

[58] Field of Search ..... 173/15, 16, 29, 48, 173/108, 114, 128, 104, 163, 139, 135, 133

[56] References Cited

U.S. PATENT DOCUMENTS

| | | | |
|---|---|---|---|
| 1,591,930 | 7/1926 | Smith | 173/114 |
| 3,028,840 | 4/1962 | Leavell | 173/139 X |
| 3,866,692 | 2/1975 | Stelljes | 173/48 |
| 3,926,266 | 12/1975 | Dorgnon | 173/48 X |
| 4,476,941 | 10/1984 | Buck et al. | 173/139 X |
| 4,624,325 | 11/1986 | Steiner | 173/139 |

*Primary Examiner*—Frank T. Yost
*Assistant Examiner*—Rinaldi Rada
*Attorney, Agent, or Firm*—Burgess, Ryan & Wayne

[57] ABSTRACT

A compression-vacuum action percussive machine is proposed, which has a casing (1) accommodating a tool (7) and a cylinder (2) with a drive piston (3) and a striker (4) having a chamfer (10) on the end face engageable with the tool (7), and also a means for trapping the striker (4), which means is made in the form of a sleeve (11) with an annular groove (13), wherein a resilient ring (14) is mounted. The sleeve (11) has an inner annular rib (15), the diameter of which is smaller than the diameter of the inner wall (12) of the sleeve (11), the annular rib (15) being positioned at the end face of the sleeve (11) facing the striker (4). The inner diameter (d) of the resilient ring (14) is smaller than the diameter (D) of the extension (9) of the striker (4), which extension is situated after the striker chamfer (10).

1 Claim, 2 Drawing Sheets

COMPRESSION-VACUUM ACTION PERCUSSIVE MACHINE

FIELD OF THE INVENTION

The invention relates to percussive machines and, more particularly, to compression-vacuum action percussive machines.

The compression-vacuum action percussive machines have a piston and a striker separated from each other by an air cushion. The striker is engageable with a pick tool and is entrained by the piston through an air cushion. When changing over to idling, it is necessary to prevent the striker from blowing against the casing which is achieved with the use of various types of striker trapping means.

BACKGROUND OF THE INVENTION

Known in the art is a compression-vacuum action percussive machine (hammer drill), which comprises a casing accommodating a cylinder and a tool and also a striker with a transition cone on its end directed towards the tool, and a striker trapping device made in the form of a resilient ring and positioned in an annular groove cut in the casing wall (GB, B, 2085795).

This compression-vacuum action percussive machine has a disadvantage of low reliability of the resilient rings. To ensure trapping the striker when the machine is transferred to idling, the inner diameter of the trapping device should be smaller than the diameter of the front end of the striker. This difference in the diameters is responsible for increased friction between the striker and the trapping device and for braking the striker relative to the casing. The speed of the striker to be damped by the trapping device is as high as 6 to 10 m/s. The striker energy reduced by the trapping device in the radial direction (the direction of its deformation), wherein the impact loads are absorbed by the trapping device thus resulting in a premature failure thereof.

Also known in the art is a compression-vacuum action percussive machine (DE, C, 2756993), comprising a casing which houses a tool, a cylinder, wherein a drive piston and a striker are driven reciprocably, the striker being separated from the piston by an air cushion and having a chamfered end face engageable with the tool. Within the cylinder is also a striker trapping means formed by a carrier sleeve installed coaxially with the striker and having an inner wall with an annular groove cut therein, and a resilient ring mounted in the annular groove of the carrier sleeve.

In this percussive machine the striker is provided with an annular rib mounted after the chamfer, the diameter of the rib being larger than the inner diameter of the resilient ring, while the diameter of the striker body after the rib is smaller than the diameter of the resilient ring. Thus, the striker has a complicated configuration responsible for the concentration of stresses, resulting from heavy conditions of the striker operation. This configuration renders the percussive machine unreliable.

In addition, in the course of a percussive operation, the striker possesses considerable energy and, when the machine is transferred to idling, the striker spreads by its annular rib the resilient ring and passes therethrough in the direction of the tool. In case of a possible recoil, the striker has a considerable lower energy and the collar, formed due to the difference between the inner diameter of the resilient ring and the outer diameter of the annular rib of the striker, is able to retain the latter from further movement towards the piston. Thus, the striker is held by the resilient ring. To transfer the machine from the idling position into the percussion operation, a force should be applied to the machine body in direction of the face to be broken. When this is done, the tool thrusts with one end onto the face to be broken, while its other end presses against the striker, and overcoming the resistance of the resilient ring, forces the striker towards the piston. Due to rarefaction in the air cushion, the drive piston draws in the striker and the working cycle of the compression-vacuum action percussive machine begins. During the direct and reverse strokes of the striker, when the annular rib of the striker moves through the resilient ring, the latter undergoes substantial deformation and resulting damage.

It is the object of the present invention to provide a striker trapping means which will ensure a difference in friction forces with the striker moving in the trapping means in any direction.

SUMMARY OF THE INVENTION

The object of the invention is attained by that in a compression-vacuum machine comprising a casing which accommodates a tool and a cylinder. A drive piston and a striker are driven reciprocably and are from each other by an air cushion. The striker has chamfer on the end face engageable with the tool, and a striker trapping means is provided in the form of a sleeve installed coaxially with the striker. The chamfer has an inner wall with an annular groove cut therein. A resilient ring is mounted in the sleeve annular groove, and, according to the invention, the sleeve has an annular rib mounted between the annular groove and the sleeve end facing the striker. The diameter of the annular rib is smaller than the diameter of the inner wall of the sleeve and larger than the diameter of the striker extension positioned just after the chamfer on its end face intended for engaging the tool, while the diameter of the resilient ring is smaller than the diameter of the said extension of the striker.

With this construction of percussive machine trapping means, the striker extension surface after the chamfer is smooth, i.e. has no ribs or grooves, thus ensuring high mechanical strength of the striker in case of dynamic loads.

The trapping means of the described construction, featuring the aforementioned relationship of the diameters of the sleeve ring portion, the resilient ring and the striker, ensures improved reliability and durability of the resilient ring. This construction eliminates alternating strains, when the machine is transferred to idling, since the striker is trapped due to the difference in friction forces between the resilient ring and the reciprocating striker. It should be pointed out that during one trapping cycle the resilient ring experiences the maximum strain, which assures trapping the striker, only once at the reverse stroke of the striker. As a result, the number of the resilient ring loading cycles is reduced by a half, thus leading to an improvement of the reliability of the resilient ring and the machine as a whole.

BRIEF DESCRIPTION OF THE DRAWINGS

The invention will now be explained in more detail by an embodiment of the invention with reference to the accompanying drawings, in which.

DETAILED DESCRIPTION

Figure 1:
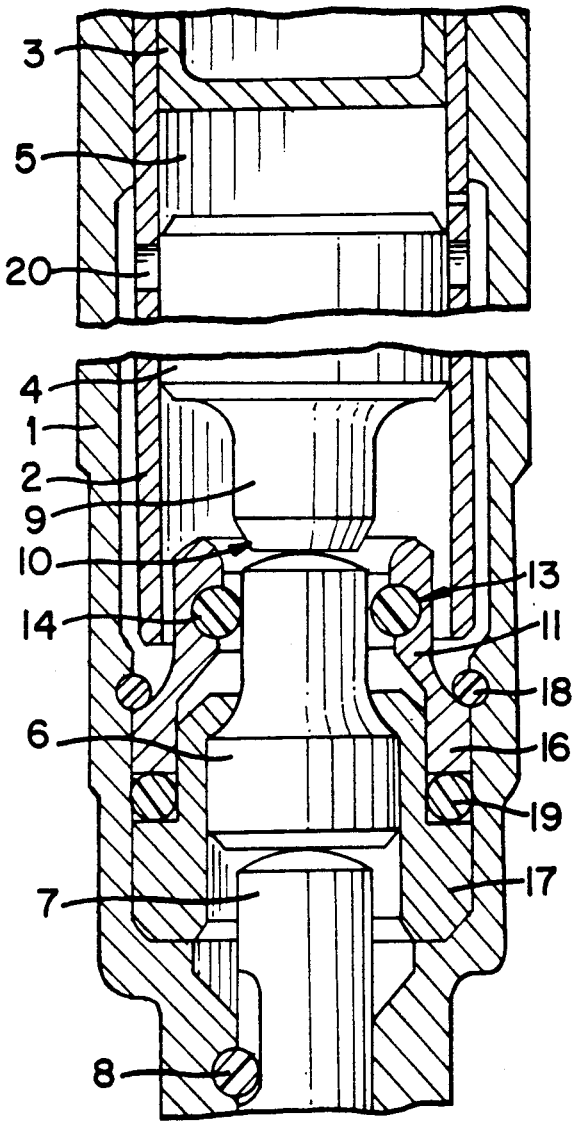
FIG. 1 is a partial longitudinal section view of a compression-vacuum action percussive machine, according to the invention, in the impact position.

With reference to FIG. 1, the compression-vacuum action percussive machine of the present invention comprises a casing 1 accommodating a cylinder 2, a drive piston 3, connected with the drive (not shown in the drawing), which makes the piston reciprocate in the cylinder 2. Arranged in the cylinder 2 is a striker 4, communicating with the piston 3 through an air cushion 5 to exert periodically, in response to the reciprocating motion of the drive piston 3 through an intermediate dolly 6, impacts upon the tool 7 retained in the casing 1 by means of a pin 8. The intermediate dolly 6 and the tool 7 are installed with an axial play relative to the casing 1 to ensure transition of the machine to idling (impactless operation). The extension 9 of the striker 4 is equal in diameter over the entire length and has a chamfer 10 at the front end face engageable with the tool 7 via the intermediate dolly 6.

According to the invention, the compression-vacuum action percussive machine is provided with a trapping means for trapping the striker 4, said trapping means being made in the form of a sleeve 11 installed in the casing 1 coaxially with the striker 4 and having an inner wall 12 (FIG. 3) and an annular groove 13 (FIGS. 1, 3) situated between the inner wall 12 and the end of the sleeve 11 facing the striker 4. The annular groove 13 accommodates an resilient ring 14 made of high-molecular-weight polymeric material (elastomer or rubber). The cross-section of the annular groove 13 is shaped congruently with the cross-section of the received portion of the resilient ring 14, while the diameter of the annular groove 13 is equal to the outer diameter of the resilient ring 14.

Figure 3:
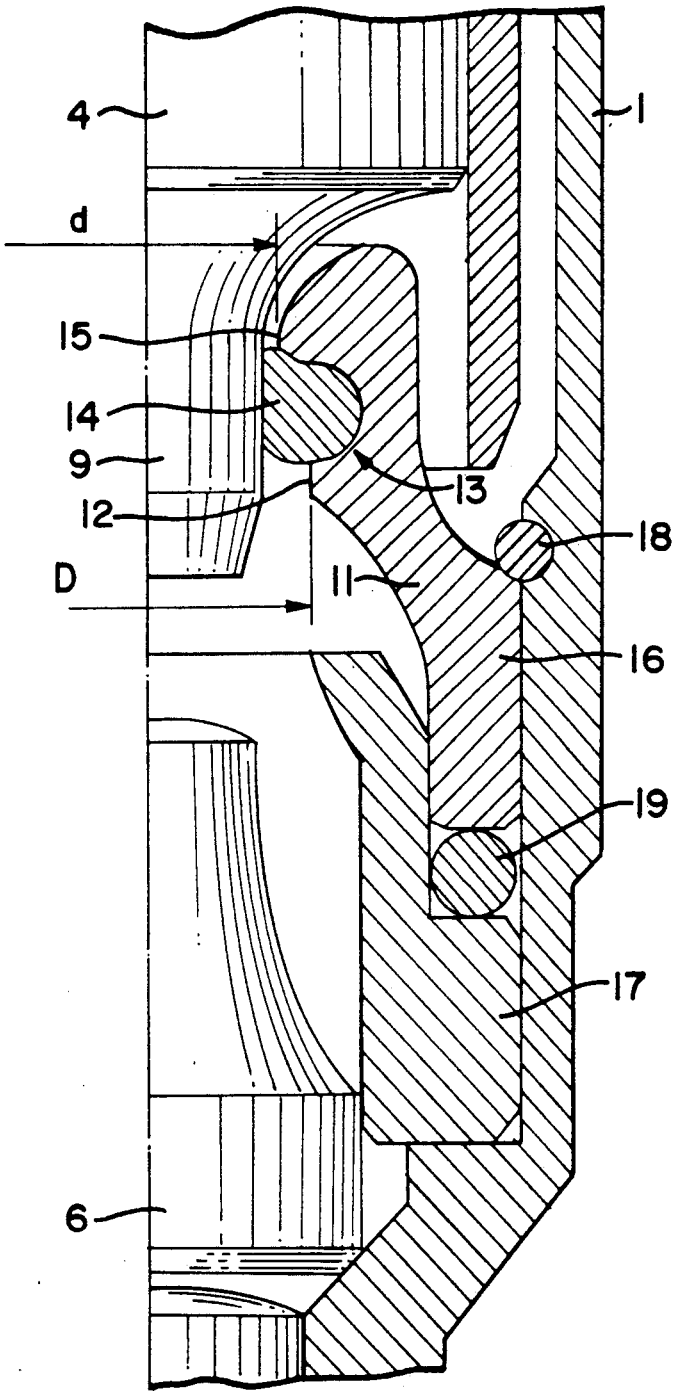
FIG. 3 is an enlarged partial longitudinal section view of the embodiment shown in FIG. 1 after the machine has been transferred to idling.

In accordance with the invention, the sleeve 11 has an inner annular rib 15 positioned between the annular groove 13 and the end face of the sleeve 11 from the side of the striker 4 (FIG. 3). The diameter "d" of the annular rib 15 is smaller than the diameter "D" of the inner wall 12 of the sleeve 11 and larger than the diameter (not indicated on the drawing) of the extension 9 of the striker 4, located after its chamfer 10 (FIG. 1). The inner diameter of the resilient ring 14 (FIG. 1) is smaller than the diameter of the extension 9 of the striker 4.

The sleeve 11 is arranged in the casing 1 with a possibility of a limited axial displacement. The shank 16 (FIG. 3) of the sleeve 11 is disposed between the casing 1 and a bushing 17 with the intermediate dolly 6 arranged therein. The sleeve 11 is fixed by a snap ring 18, while a shock absorber 19 is placed between the end face surface of the shank 16 of the sleeve 11 and the collar of the bushing 17 to damp impacts during transferring the machine to idling. The cylinder 2 is provided with two idle run ports 20 closed with the side surface of the striker 4 in the course of the machine impact operation (FIG. 1) and communicating the air cushion 5 (FIG. 2) with the atmosphere, when the machine is transferred from the impact operation to idling.

The proposed compression-vacuum action percussive machine operates as follows.

Figure 2:
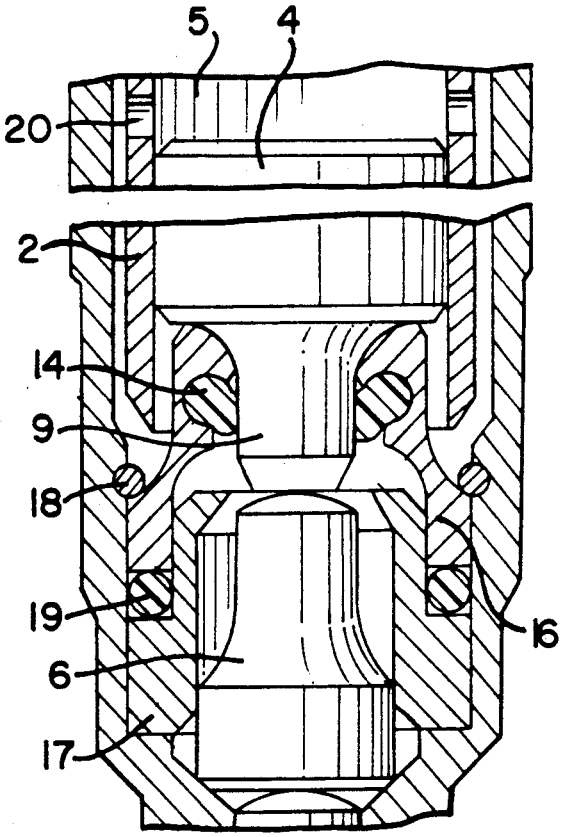
FIG. 2 is a partial longitudinal section view of a compression-vacuum action percussive machine of the embodiment shown in FIG. 1 (in the position of the initial stage of the machine transition to idling)

When the machine is transferred from the impact operation (position shown in FIG. 1) to idling (FIG. 2), the casing 1 moves upwards, while the tool 7 and the intermediate dolly 6, installed in the casing 1 with an axial play, remain in the impact operation position. The striker 4 tends to conserve contact with the intermediate dolly 6 and continues to strike blows thereupon. With each blow the striker 4 opens the idle run ports 20 more and more until the extension 9 of the striker 4 comes into contact with the resilient ring 14 at a direct stroke of the striker 4. Due to the difference between the diameters "D" and "d" of the extension 9 of the striker 4 and the inner diameter of the resilient ring 14, the cross-section of the resilient ring changes as shown in FIG. 2. Since the resilient ring 14 is positioned in the inner annular groove 13 of the sleeve 11 and the surface of a part of the ring cross-section is in full contact with the surface of the annular groove 13, deformation of the remaining part of the resilient ring is possible only in the direction of the space between the extension 9 of the striker 4 and the wall 12 of the sleeve 11.

The force of friction between the resilient ring 14 and the extension 9 of the striker 4 during its movement towards the tool 7 makes the resilient ring 14 deform so that it occupies partially the space between the extension 9 of the striker 4 and the wall 12 of the sleeve 11 from the side of the tool 7. The friction force arising from the relative movement of the extension 9 of the striker 4 and the resilient ring 14 brakes the striker 4 reducing to some extent its speed and consequently the kinetic energy thereof.

The sleeve 11 accommodating the resilient ring 14 limits displacement of the striker 4 (FIG. 1). Some kinetic energy of the striker 4 is transferred to the sleeve 11 as a result of a collision of the striker 4 and the trapping means. As a result, the energy of the following recoil of the striker 4 from the sleeve 11 is reduced and the striker 4 moves from the tool 7 at a lower speed. The speed of the striker 4 is damped completely as a result of its contact with the resilient ring 14. The friction force arising between the extension 9 of the striker 4 and the resilient ring 14, when the striker 4 recoils (in the direction opposite to the direct stroke), makes the zone of the resilient ring 14, adjacent to the striker 4, move together with the resilient ring 14 (FIG. 3). As a result, a portion of the resilient ring 14 enters the space between the extension 9 of the striker 4 and the annular rib 15 of the sleeve 11. Since the diameter "d" of the annular rib 15 is smaller than the diameter "D" of the inner wall 12 of the sleeve 11, the free space which may receive the resilient ring 14 in the zone of the annular rib 15 is smaller than the free space in the zone of the wall 12. Accordingly, the force of compression of the resilient ring 14 in the zone of the annular rib 15 is stronger than in the zone of the wall 12 and therefore, the force of friction between the resilient ring 14 and the extension 9 of the striker 4 increases. This increase results in further displacement of the resilient ring 14 into the zone of the inner annular rib 15 of the sleeve 11 and in further increase of the force of compression of the resilient ring 14. Finally, the recoil speed of the striker 4 drops and the kinetic energy of the striker 4 transforms gradually into the strain energy of the resilient ring 14 and thermal energy of friction. At this point, the resilient ring 14 experiences maximum deformation resulting in the full braking of the striker 4, thereby trapping of the striker 4 and transfering the machine to the idling position.

Transferring of the machine from the idling position to the impact operation is carried out in reverse order. The casing 1 of the machine is moved forward relative to the tool 7, which in turn forces the striker 4 through the intermediate dolly 6 into the cylinder 2. The striker 4 overcomes the frictional force between the resilient ring 14 and the extension 9 of the striker 4 then, the striker loses contact with the resilient ring 14 and closes the idle run ports 20 by its end face. This leads once again to the formation of the air cushion 5 and the striker 4 starts its impact operation under the action of the reciprocating piston 3.

The inner annular rib 15 of the sleeve 11 in the zone of the resilient ring 14 has a diameter smaller than the diameter of the wall 12 of the sleeve 11 which allows an increase in the frictional force between the striker 4 and the resilient ring 14 at the reverse stroke of the striker 4 as compared with the frictional force acting at the direct stroke of the striker 4. In this case the maximum deformation of the resilient ring 14, which deformation results in full stop of the striker 4, takes place only at a reverse stroke of the striker 4, thus doubling the reliability of the resilient ring 14.

INDUSTRIAL APPLICABILITY

The invention can be used in civil engineering, mining and other industrial branches for breaking various materials and drilling holes.

We claim:

1. A compression-vacuum action percussive machine comprising:

a casing (1) accommodating a tool (7) at one end thereof;

a cylinder (2) within the casing (1) for housing a piston (3) adapted to reciprocally move within the cylinder (2);

a striker (4) having an extension (9) including an end face formed by a chamfer (10) facing the tool (7) for impacting on the tool (7) and being separated from the piston (3) by a cushion of air (5); and means for trapping the striker comprising, a sleeve (11) coaxial with the striker (4) and having an end facing the striker (4) and an annular groove (13) formed within an inner wall (12) of the sleeve (11) containing a resilient ring (14) wherein a portion of the resilient ring (14) conforms to the shape of the annular groove (13), an inner annular rib (15) between the annular groove (13) and said end of the sleeve (11), wherein the diameter (d) of the annular rib (15) is smaller than the diameter (D) of the inner wall (12) of the sleeve (11) and greater than the diameter of the extension (9) at the end face, and the inner diameter of the resilient ring (14) is smaller than the diameter of the extension (9) of the striker (4).

* * * * *